US006113362A

United States Patent [19]

Schmieder et al.

[11] Patent Number: 6,113,362

[45] Date of Patent: Sep. 5, 2000

[54] FLOW PUMP FOR CONVEYING FLUIDS FROM STORAGE TANK TO FLUID CONSUMER

[75] Inventors: Dietmar Schmieder, Markgroeningen; Willi Strohl, Beilstein; Jochen Rose, Hemmingen; Erich Eiler, Sersheim, all of Germany

[73] Assignee: Robert Bosch GmbH, Stuttgart, Germany

[21] Appl. No.: 09/101,916

[22] PCT Filed: Oct. 15, 1997

[86] PCT No.: PCT/DE97/02355

§ 371 Date: Jul. 20, 1998

§ 102(e) Date: Jul. 20, 1998

[87] PCT Pub. No.: WO98/26184

PCT Pub. Date: Jun. 18, 1998

[30] Foreign Application Priority Data

Dec. 12, 1996 [DE] Germany ..... 196 51 650

[51] Int. Cl.[7] ..... F04B 17/00

[52] U.S. Cl. ..... 417/423.1; 417/366; 415/55.1

[58] Field of Search ..... 417/423.1, 366, 417/365; 415/55.1, 55.2, 55.3, 55.4, 58.4

[56] References Cited

U.S. PATENT DOCUMENTS 4,649,884 3/1987 Turckey .

*Primary Examiner*—Teresa Walberg
*Assistant Examiner*—Jeffrey C Pwu
*Attorney, Agent, or Firm*—Michael J. Striker

[57] ABSTRACT

In connection with a flow pump, particularly for the conveying of fuel from a fuel tank of a motor vehicle, with a pump chamber (16), an impeller wheel (24) rotating in the pump chamber (16), and two parallel side walls (17, 18) spaced apart from each other and delimiting the pump chamber (16), in one of which a groove-like side channel (26), open toward the pump chamber (16), is disposed, which extends concentrically to the pump axis from a channel start (261) to a channel end (262), a further pump inlet (30) for the connection of a fluid return line (13) and which opens directly into the side channel (26) at a distance from the channel end (262), is provided for the purpose of improved efficiency of the flow pump.

6 Claims, 2 Drawing Sheets

FLOW PUMP FOR CONVEYING FLUIDS FROM STORAGE TANK TO FLUID CONSUMER

BACKGROUND OF THE INVENTION

The invention relates to a flow pump for the conveying of fluids from a storage tank to a fluid consumer, particularly for the conveying of fuel from a fuel tank to a fuel injection system of an internal combustion engine.

A flow pump of this species is known, for example, from DE 40 20 521 A1, and is used in internal combustion engines with fuel injection systems for the supply of fuel from a fuel tank to the fuel injection system. A fuel injection system with an integrated fuel flow pump in the fuel tank is for example known from U.S. Pat. No. 4,649,884. The electrically powered flow pump in these fuel injection systems always conveys sufficient fuel from the fuel tank, independently of the actual fuel consumption of the internal combustion engine, so that the maximal fuel consumption of the internal combustion engine and any additional quantities required by the system are completely covered. The pressure in the excess quantity of fuel is reduced in a pressure regulator and it is returned again into the fuel tank via a return line. The pressure regulator thus represents a regulated choke cross section, in which the hydraulic energy carried along by the fuel under pressure is transformed into current turbulence, heat and partially also evaporating heat. In this way, on average approximately 90% of the hydraulic output generated by the flow pump are destroyed again.

SUMMARY OF THE INVENTION

Accordingly, it is an object of the present invention to provide a flow pump for conveying fluids from a storage tank to a fluid consumer, which avoids the disadvantages of the prior art.

In keeping with these objects, one feature of present invention, resides, briefly stated, in a flow pump in which a further pump inlet for connection of a return line returning a conveyed surplus is provided, and the further pump inlets open into a side channel at a distance from the channel start and at a distance from the channel end.

When the flow pump is designed in accordance with the present invention, it has the advantage, that by introducing the returning surplus conveyed quantities into the side channel of the flow pump, the pressure of the returning conveyed quantity is reduced in the pressure regulator to only a pressure, which is built up by the flow pump at the mouth of the return line, and it is reintroduced into the flow pump at this remaining pressure. In this way a large part of the hydraulic energy generated by the flow pump during the conveying action is fed back into the flow pump, so that the degree of efficiency of the flow pump is significantly improved. Naturally the improvement of the degree of efficiency depends on the returning quantity and thus the actually used quantity of fluid. In connection with internal combustion engines, the degree of improvement of the efficiency is maximal when running in neutral and minimal when under full load. In all cases, however, the result is a reduced performance of the flow pump as a function of the quantities used.

The degree of improvement of the efficiency also depends on the location in the side channel where the returned conveying quantity is reintroduced. In accordance with a preferred embodiment of the invention, a point of the side channel has proven as optimal, where approximately 60 to 70% of the final pressure of the flow pump is built up.

BRIEF DESCRIPTION OF THE DRAWINGS

The invention will be explained in more detail in the following description by means of an exemplary embodiment represented in the drawings. Shown are in.

DESCRIPTION OF THE PREFERRED EMBODIMENT

Figure 1:
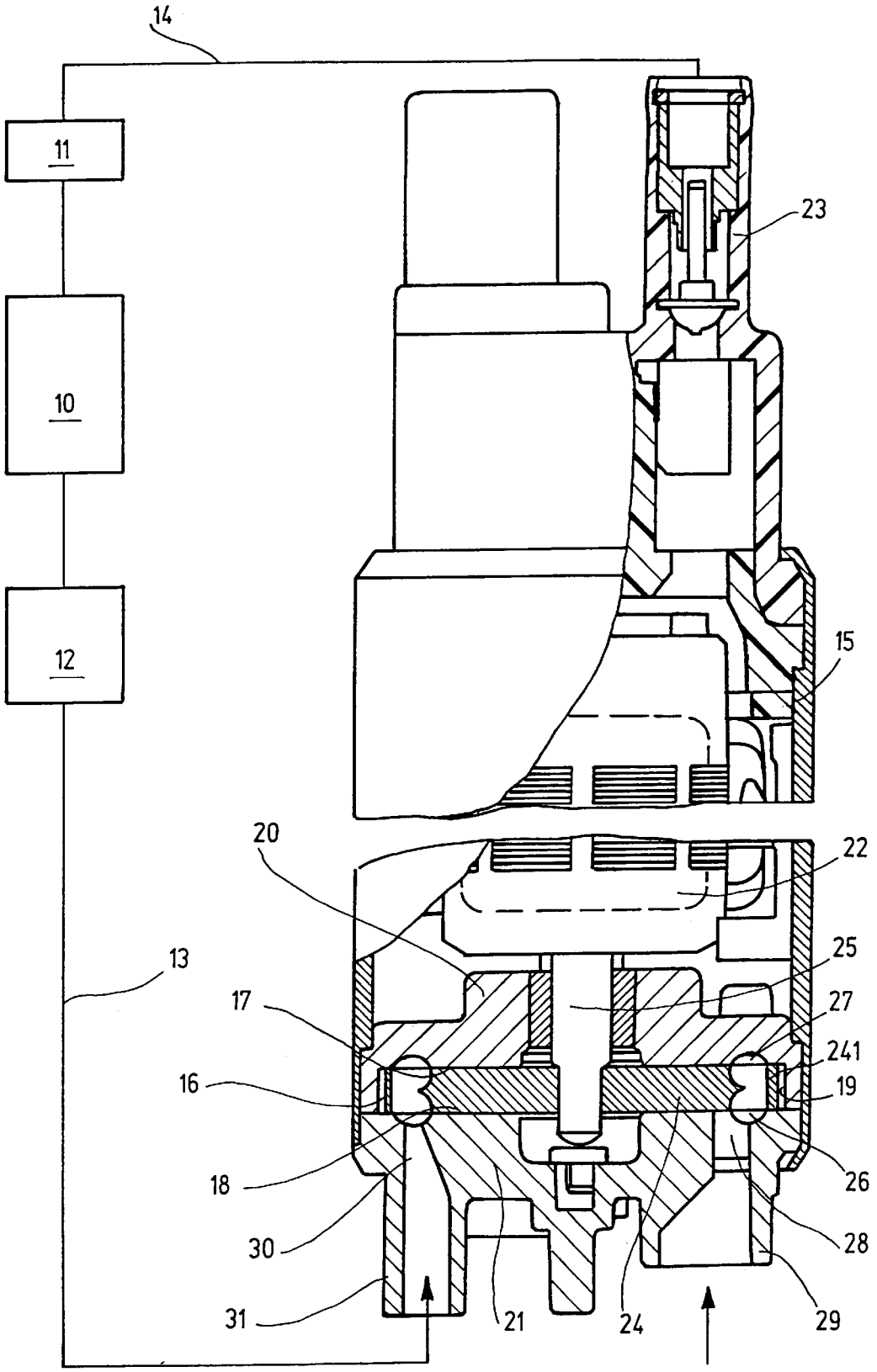
FIG. 1, a lateral view of the flow pump, partially in section, in a fuel conveying cycle with a fuel conveying line, fuel injection system and fuel return line of an internal combustion engine, FIG. 2, a plan view of a housing cover of the flow pump in FIG. 1.

The flow pump shown in lateral view, and partially in section in FIG. 1, also called side-channel pump, is used for conveying fuel out of a fuel tank, not represented, to a fuel injection system 10 of an internal combustion engine, not represented here of a motor vehicle, wherein the fuel pump is customarily arranged in a fuel tank. The fuel conveyed by the flow pump in a conveyor line 14 in this case at first passes through a fuel filter 11 and then is distributed in a fuel distributor to the individual fuel injection nozzles assigned to the combustion cylinders of the internal combustion engine. The excess fuel not being injected is introduced via a pressure regulator 12 into a fuel return line 13 which leads back to the flow pump.

The flow pump has a pump chamber 16 embodied in a pump housing 15, which is delimited by two radially extending, axially spaced apart lateral walls 17, 18, and a peripheral wall 19 connecting the lateral walls along their periphery. The lateral wall 17 and the peripheral wall 19 are embodied on a pump housing 15 affixed to a pump housing 15, while the lateral wall 18 is embodied on an aspirating or housing cover 21, which is firmly connected with the intermediate housing 20. The pump housing 15, which receives an electric motor 22 and a pump outlet valve 23, overlaps the intermediate housing 20 and is crimped on the housing cover 21. An outlet channel penetrating the lateral wall 17 is further provided in the intermediate housing 20, which makes a connection between the pump chamber 16 and the interior of the pump housing 15, from which the conveyed fuel reaches the conveyor line 14 via the pump outlet valve 23.

A pump or impeller wheel 24 is disposed coaxially with the pump axis in the pump chamber 16, which is seated, fixed against relative rotation, on an output shaft 25 of the electric motor 22, which in turn is seated in the intermediate housing 20. The impeller wheel 24 has a plurality of impeller wheel vanes, not shown in detail here, spaced apart from each other in the circumferential direction, which are connected with each other at their ends facing away from the pump axis by means of a circular outer ring 241.

Figure 2:
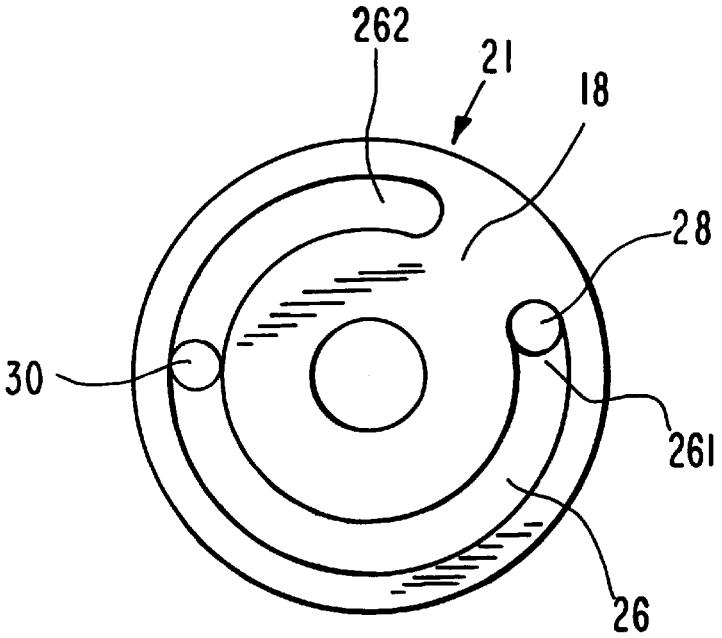

In a single flow pump, a side channel 26 in the lateral wall 18 formed by the housing cover 21 and extending concentrically in relation to the pump axis, is embodied as a groove approximately semicircular-shaped in cross section, which is open toward the pump chamber 16. The side channel 26 extends from a channel start 261 to a channel end 262, wherein a strip remains between the channel start 261 and the channel end 262 (compare FIG. 2). In a dual flow pump—as shown in FIG. 1—a similar side channel 27 has been cut in the lateral wall 17 created by the intermediate housing 20, whose channel end is located at the mouth opening of the connecting channel to the interior of the pump housing 15, not represented here.

A pump inlet 28 opens into the channel start 261 of the side channel 27, which is enclosed by a induction pipe 29 and through which the flow pump aspirates fuel from the fuel tank. In addition, a further pump inlet 30, which is enclosed by a connector 31, opens into the side channel 26 at a distance from the channel end 262. The induction pipe 29 and the connector 31 are embodied as one piece with the housing cover 21. The mouth of the further pump inlet 30 (FIG. 2) in the side channel 26 preferably is positioned at such a location of the side channel 26 where approximately 50 to 80%, particularly approximately 60 to 70% of pump end pressure is being built up when the flow pump operates. The return line 13 is connected to the connector 31, so that the fuel returned from the injection system via the pressure regulator 12 is reintroduced into the flow pump. Since the feed location for the fuel in the flow pump is under a pressure that amounts to approximately 60 to 70% of the pump end pressure, the pressure of the fuel in the pressure regulator 12 can only be reduced to this pressure level, so that part of the hydraulic energy impressed on the fuel by the flow pump during conveyance is returned to the flow pump, so that the degree of efficiency of the latter is improved.

What is claimed is:

1. A flow pump for the conveying of fluids from a storage tank to a fluid consumer, particularly for the conveying of fuel from a tank to a fuel injection system of an internal combustion engine, with a pump chamber (16) embodied in a pump housing (15) which is delimited by two parallel lateral walls (17, 18) spaced apart from each other, with at least one groove-like side channel (26), which is open toward the pump chamber (16), disposed in one of the side walls (18) and which extends concentrically in relation to the pump axis from a channel start (261) to a channel end (262) separated therefrom, with a pump inlet (28) opening into the channel start (261) and with a rotating pump or impeller wheel (24) disposed coaxially with the pump axis in the pump chamber (16), with a further pump inlet (30) for the connection of a return line (13) returning a conveyed surplus is provided, and the further pump inlet (30) opens in the side channel (26) at a distance from the channel start (26') and at a distance from the channel end (262).

2. The pump in accordance with claim 1, wherein the further pump inlet (30) opens at a location of the side channel (26) where approximately 50 to 80%, particularly approximately 60 to 70% of the pump end pressure is built up.

3. The flow in accordance with claim 1, wherein the further pump inlet (30) is provided with a connector (31) for the return line (13).

4. The flow in accordance with claim 3, wherein the connector (31) and an induction pipe (29) enclosing the pump inlet (28) are embodied in a housing cover (21) that frontally seals the pump housing (15) and contains the lateral wall (18) with the side channel (26) delimiting the pump chamber (16).

5. The pump in accordance with claim 1, wherein the induction pipe (29), the connector (31) and the lateral wall (26) are embodied as one piece with the housing cover (21).

6. The pump in accordance with claim 1, wherein it is disposed in a fuel supply device for a fuel injection system of an internal combustion engine, which has a conveying line (14) connected to a pump outlet (pump outlet valve 23), and a fuel return line (13) leading away from a downstream located pressure regulator (12) of the fuel injection system (10), and by the return line (13) being connected to the connector (31) which encloses the further pump inlet (30).

* * * * *